United States Patent [19]

Kiley

[11] Patent Number: 4,459,219

[45] Date of Patent: Jul. 10, 1984

[54] BLACK SMOKE GENERATOR AND METHOD OF USE THEREOF

[75] Inventor: Leo R. Kiley, Whitehall, Mich.

[73] Assignee: Teledyne Industries, Inc., Los Angeles, Calif.

[21] Appl. No.: 275,727

[22] Filed: Jun. 22, 1981

Related U.S. Application Data

[63] Continuation-in-part of Ser. No. 83,286, Oct. 10, 1979, Pat. No. 4,282,113.

[51] Int. Cl.[3] ..... C09K 3/30; B01F 3/06

[52] U.S. Cl. ..... 252/305; 102/334; 252/359 CG; 343/18 E

[58] Field of Search ..... 252/305, 359 CG; 102/334; 60/606, 624, 735; 343/18 E

[56] References Cited

U.S. PATENT DOCUMENTS

| | | | |
|---|---|---|---|
| 2,620,621 | 12/1952 | Nettel | 60/606 X |
| 3,163,984 | 1/1965 | Dumont | 60/606 |
| 3,244,641 | 4/1966 | Dürr et al. | 252/359 CG |
| 4,112,684 | 9/1978 | Tholen | 60/606 |
| 4,282,113 | 8/1981 | Kiley | 252/359 CG |

FOREIGN PATENT DOCUMENTS

| | | | |
|---|---|---|---|
| 681554 | 3/1964 | Canada | 252/305 |
| 2912751 | 10/1979 | Fed. Rep. of Germany | 252/305 |

*Primary Examiner*—Richard D. Lovering
*Attorney, Agent, or Firm*—Gifford, VanOphem, Sheridan, Sprinkle & Nabozny

[57] ABSTRACT

A black smoke generator is provided for generating a smoke screen for use on military vehicles, installations and the like. The black smoke generator is a self-sustaining unit and comprises a compressor having an outlet, a turbine having an inlet and a burner assembly operatively connected between the compressor outlet and the turbine inlet. The burner assembly has a housing which defines a combustion chamber while fuel is supplied to the combustion chamber at a rate which produces an excessively rich fuel/air mixture in the combustion chamber. Upon ignition of the fuel/air mixture in the combustion chamber, black smoke is exhausted through the turbine which simultaneously drives the compressor. A method for generating black smoke is also disclosed.

12 Claims, 1 Drawing Figure

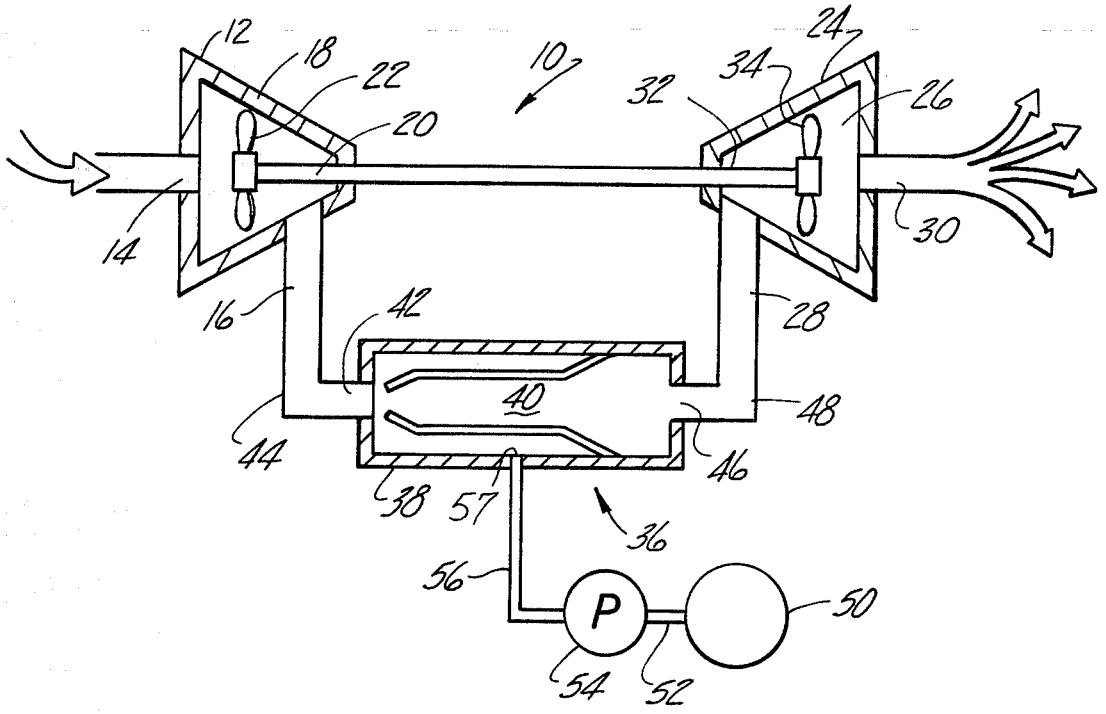
12
18
22
20
10
32
34
24
26
14
30
16
42
28
40
48
44
46
38
57
36
56
P
50
54
52

BLACK SMOKE GENERATOR AND METHOD OF USE THEREOF

CROSS REFERENCE TO RELATED APPLICATIONS

The instant application is a continuation-in-part application of U.S. Ser. No. 83,286 filed Oct. 10, 1979 entitled BLACK SMOKE GENERATOR now U.S. Pat. No. 4,282,113, issued Aug. 4, 1981.

BACKGROUND OF THE INVENTION

I. Field of the Invention

The present invention relates generally to smoke generators and, more particularly, to a method and device to generate black smoke.

II. Description of the Prior Art

Smoke generators are employed on a number of different military vehicles and the like for producing a smoke screen to hide or obscure the military vehicle. Previously, these military vehicles have utilized smoke generators to produce a cloud of smoke which encompasses the vehicle.

These previous smoke generators, however, are disadvantageous for a number of different reasons. First, the smoke generators require a separate and special energy source which must be carried on board the military vehicle, for example smoke generates. Thus, when the energy source for the smoke generator has been exhausted, the vehicle cannot generate smoke until the energy source has been replenished. Replenishment of the energy source in the field, however, is oftentimes impractical or altogether impossible.

A still further disadvantage of the previously known white smoke generators which rely on vaporized fuel is that while the white smoke generator provides adequate visual protection for the military vehicle, no shielding from infrared detection devices is obtained.

For these reasons, white smoke generators have been used only with limited success with military vehicles and the like.

SUMMARY OF THE PRESENT INVENTION

The present invention overcomes the disadvantages of the previously known smoke generators by providing a method and device to generate black smoke from a military vehicle or the like and which operates on the same fuel as the vehicle. The present invention further provides greater shielding from infrared detection devices than is obtainable from the previously known white smoke generators.

In brief, the smoke generator is a self-energizing and self-sustaining unit and comprises a turbine compressor having an air intake and a compressed air outlet and a turbine expander having an inlet and an exhaust gas outlet. A turbine shaft interconnects the turbine with the compressor so that as gases expand through the turbine, the turbine rotatably drives the shaft which, in turn, rotatably drives the compressor.

The smoke generator further comprises a burner housing defining a combustion chamber having an inlet and an outlet. The combustion chamber inlet is connected to the compressed air outlet from the compressor while, similarly, the outlet from the combustion chamber is connected to the turbine inlet. In addition, a source of fuel, preferably diesel fuel, is supplied to the combustion chamber at a flow rate which produces an excessively rich fuel/air mixture within the combustion chamber. Thus, upon ignition of the fuel/air mixture within the combustion chamber, excessive black smoke is generated which exhausts through the turbine and out through the turbine exhaust outlet.

In practice, the excessive fuel is supplied to the engine at a rate sufficient to produce a stoichiometric fuel/air ratio in the area around the fuel injection nozzle, i.e., the so-called "primary zone" in the turbine engine combustion chamber. In other areas of the combustion chamber, the fuel/air ratio is much less than stoichiometric.

The exhausting of the black smoke through the turbine expander rotatably drives the turbine shaft and thus the compressor so that the black smoke generator is self-sustaining. Moreover, since the black smoke after exhaustion from the turbine is highly elevated in temperature, improved shielding from infrared detection devices is obtained.

BRIEF DESCRIPTION OF THE DRAWING

A better understanding of the present invention will be had upon reference to the following detailed description when read in conjunction with the accompanying drawing, in which the single drawing figure is a diagrammatic view illustrating one form of the smoke generator according to the present invention.

DETAILED DESCRIPTION OF A PREFERRED EMBODIMENT OF THE PRESENT INVENTION

With reference to the drawing, a preferred embodiment of the smoke generator 10 according to the present invention is thereshown which is self-energizing and self-sustaining in operation as will become shortly apparent. Consequently, the smoke generator 10 illustrated can be advantageously employed as a smoke generator for a military vehicle, a military installation or the like.

The smoke generator 10 comprises an air compressor means 12 having an air intake 14 and a compressor outlet 16. Preferably the compressor means 12 is a turbine compressor and, as such, includes a housing 18 in which a compressor driven shaft 20 is rotatably mounted. A compressor wheel 22 (illustrated only diagrammatically) is secured to the shaft 20 within the compressor housing 18 so that, upon rotation of the shaft 20, the compressor means 12 inducts air from its air intake 14 and produces compressed air at its outlet 16.

The smoke generator 10 further comprises an expander means 24 having a housing 26 with an inlet 28 and an exhaust outlet 30. Preferably the expander means 24 is a turbine expander and, as such, includes a drive shaft 32 rotatably mounted to the housing 26 and a turbine wheel 34 secured to the shaft 32 within the expander housing 26. The flow of gases from the expander inlet 28 and to its outlet 30 rotatably drives the turbine wheel 34 which simultaneously rotatably drives the expander drive shaft 32. Moreover, the expander shaft 32 is mechanically connected with the compressor shaft 20 so that rotation of the expander shaft 32 rotatably drives the compressor driven shaft 20. Any conventional means can be used to drivingly connect the expander shaft 32 with the compressor shaft 20 or, alternatively, the shafts 32 and 20 can be a single shaft.

The smoke generator 10 of the present invention further comprises a burner assembly 36 having a burner housing 38 which defines an interior combustion chamber 40. The burner housing 38 includes a compressed air inlet 42 which is fluidly connected to fluid conduit means 44 to the compressed air outlet 16 from the compressor 12. Similarly, the burner housing 38 includes an outlet 46 which is fluidly connected by fluid conduit means 48 to the expander inlet 28.

A source of fuel 50, preferably a hydrocarbon fossil fuel such as diesel fuel, is connected by a conduit 52 to a pump means 54. The pump means 54, upon activation, pumps fuel from the fuel source 50, through a conduit 56 and to a fuel injection nozzle 57. The fuel injection nozzle 57 is open to the combustion chamber 40 so that, upon activation, the pump means 54 supplies fuel to the combustion chamber 40 through the nozzle 57.

The pump means 54 supplies fuel to the combustion chamber 40 at a rate sufficiently excessive to produce substantially a stoichiometric fuel/air ratio, i.e., a fuel-/air ratio of about 0.067, in the area of the injection nozzle 57, commonly known as the primary zone. The fuel/air mixture in the combustion chamber 40 is heterogeneous by nature so that the fuel/air ratio is leaner in areas outside the combustion chamber primary zone. However, in areas outside the primary zone the fuel/air ratio is also excessive and approaches or exceeds a 0.017 ratio.

As should be clear from the foregoing, the smoke generator 10 is a turbine engine with the exception that the pump means 54 supplies fuel to the combustion chamber 40 at a rate sufficient to create a stoichiometric or excessively rich fuel/air mixture in the combustion chamber primary zone. In operation, the smoke generator 10 is started in any conventional fashion and the excessively rich fuel/air mixture within the combustion chamber 40 is ignited by conventional means. Upon ignition, the hot and expanding gases from the combustion chamber 40 exhaust through the expander means 24 and, in doing so, rotatably drive the compressor means 12 via the shafts 32 and 20. Consequently, the smoke generator 10 of the present invention is self-sustaining in operation.

Since the pump means 54 supplies fuel to the combustion chamber 40 at a rate sufficient to provide an excessively rich fuel/air mixture, the combustion of the fuel-/air mixture within the combustion chamber 40 generates large quantities of black smoke and this black smoke expands through the turbine expander and is exhausted from its outlet 30 to provide the desired smoke screen. Moreover, the black smoke which is exhausted from the turbine expander consists largely of heated soot which provides improved shielding from infrared detection devices in contrast to the previously known white smoke generators.

The method of the present invention comprises the steps of supplying fuel to the combustion chamber 40 at an excessive rate sufficient to produce substantially a stoichiometric fuel/air ratio in the combustion chamber primary zone and then igniting the fuel. In view of the foregoing detailed description of the black smoke generator, a further description of the method of the present invention is unnecessary and will not be here repeated.

The present invention is advantageous in that no special logistic support or fuel source is needed to operate the black smoke generator 10. Furthermore, during operation, no measurable degradation of the engine power is experienced despite operation of the black smoke generator.

From the foregoing, it can be seen that the present invention provides an improved black smoke generator for use with military vehicles, military installations and the like which produces not only a visual screen but also improved infrared shielding.

Having described my invention, however, many modifications thereto will become apparent to those skilled in the art to which it pertains without deviation from the spirit of the invention as defined by the scope of the appended claims.

I claim:

1. A black smoke generator comprising:

an air compressor having a housing, said housing having an air intake and an air outlet, said compressor further comprising a driven shaft rotatably mounted to the housing and means for inducting air into said air intake and for producing compressed air out the air outlet upon the rotation of said driven shaft;

an expander having a housing, said housing having an inlet and an exhaust outlet, said expander further comprising a drive shaft rotatably mounted to the expander housing, said drive shaft being rotatably driven upon the flow of gases through said expander housing from said air inlet and to said exhaust outlet;

means for drivingly connecting said drive and driven shafts together;

a burner assembly having a housing defining a combustion chamber, said housing having a compressed air inlet connected to said compressor outlet and an exhaust outlet connected to said expander inlet;

a fuel nozzle open to said combustion chamber, means for supplying fuel through said nozzle and to the combustion chamber at a rate which produces substantially a stoichiometric fuel/air ratio in the area of the combustion chamber adjacent the fuel nozzle; and means for igniting the fuel/air mixture in the combustion chamber.

2. The invention as defined in claim 1 additionally comprising a hydrocarbon fossil fuel.

3. The invention as defined in claim 1 additionally comprising diesel fuel.

4. The invention as defined in claim 1 wherein said fuel supplying means produces a fuel/air ratio of substantially 0.067 in the area of the combustion chamber adjacent the fuel nozzle.

5. The invention as defined in claim 1 wherein said fuel supplying means produces a fuel/air less than stoichiometric in areas of the combustion chamber spaced from the fuel nozzle.

6. The invention as defined in claim 5 wherein said fuel supplying means produces a fuel/air ratio in areas of the combustion spaced from the fuel nozzle of at least about 0.017.

7. The invention according to claim 1 additionally comprising a smoke producing fuel.

8. The invention according to claim 1, wherein said fuel supplying means is the sole means for supplying a smoke producing material to said generator.

9. A method for producing black smoke from a turbine engine of the type having an air compressor with an air intake inlet and a compressed air outlet, a combustion chamber having an inlet and an outlet, said combustion chamber inlet being connected to the compressed air outlet, turbine expander having an inlet and an outlet, said turbine expander inlet being connected to the combustion chamber outlet, and a fuel nozzle open to the combustion chamber; wherein said compressor comprises a driven shaft and said expander comprises a drive shaft, and said engine comprises means for drivingly connecting said drive and driven shafts together; said method comprising the steps of:

supplying fuel to said combustion chamber through said fuel nozzle at a rate which produces a substantially stoichiometric fuel/air ratio in the area of the combustion chamber adjacent the fuel nozzle, and igniting said fuel/air mixture in the combustion chamber to thereby produce black smoke which exhausts through the turbine expander outlet.

10. The method as defined in claim 9 and further comprising the step of forming a fuel/air ratio of at least 0.017 in areas of the combustion chamber spaced from the fuel nozzle.

11. A method for producing black smoke from a turbine engine of the type having an air compressor with an air intake inlet and a compressed air outlet, a combustion chamber having an inlet and an outlet, said combustion chamber inlet being connected to the compressed air outlet, a turbine expander having an inlet and an outlet, said turbine expander inlet being connected to the combustion chamber outlet, and a fuel nozzle open to the combustion chamber; wherein said compressor comprises a driven shaft and said expander comprises a drive shaft, and said engine comprises means for drivingly connecting said drive and driven shafts together; said method comprising the steps of:

supplying fuel to said combustion chamber through said fuel nozzle at a rate which produces a substantially stoichiometric fuel/air ratio in the area of the combustion chamber adjacent the fuel nozzle;

maintaining said engine substantially free of any smoke-producing material other than said fuel; and igniting said fuel/air mixture in the combustion chamber to thereby produce black smoke which exhausts through the turbine expander outlet.

12. The method as defined in claim 11 and further comprising the step of forming a fuel/air ratio of at least 0.017 in areas of the combustion chamber spaced from the fuel nozzle.

* * * * *

UNITED STATES PATENT AND TRADEMARK OFFICE

CERTIFICATE OF CORRECTION

PATENT NO. : 4,459,219

DATED : July 10, 1984

INVENTOR(S) : Leo R. Kiley

It is certified that error appears in the above—identified patent and that said Letters Patent is hereby corrected as shown below:

Column 1, line 28 delete "generates" insert --grenades--.

Signed and Sealed this

*Eleventh* Day of *December 1984*

[SEAL]

*Attest:*

GERALD J. MOSSINGHOFF

*Attesting Officer*

*Commissioner of Patents and Trademarks*